United States Patent [19]

Webber

[11] Patent Number: 4,645,113

[45] Date of Patent: Feb. 24, 1987

[54] CONTAINER MAKING DEVICE

[76] Inventor: Ronald R. Webber, 14 Tui Street, Te Puke, New Zealand

[21] Appl. No.: 598,668

[22] Filed: Apr. 10, 1984

[51] Int. Cl.[4] ..... B27F 7/17; B25D 17/28

[52] U.S. Cl. ..... 227/154; 227/41; 227/106; 227/155; 269/69

[58] Field of Search ..... 227/41, 106, 148, 131, 227/154, 155, 8, 151; 269/37, 63, 69, 70, 905, 910

[56] References Cited

U.S. PATENT DOCUMENTS

| | | | |
|---|---|---|---|
| 1,026,679 | 5/1912 | King | 227/155 |
| 2,200,560 | 5/1940 | Newhouse | 227/148 |
| 2,394,630 | 2/1946 | Mitchell | 29/288 |
| 2,554,026 | 5/1951 | Harrison | 227/154 |
| 2,559,028 | 7/1951 | Oberwegner | 269/70 |
| 2,659,885 | 11/1953 | Kirby | 227/154 |
| 2,883,666 | 4/1959 | Moore | 227/131 |
| 3,371,921 | 3/1968 | Hollomon et al. | 269/910 X |
| 4,235,005 | 11/1980 | James | 29/281.1 |

FOREIGN PATENT DOCUMENTS

| | | | |
|---|---|---|---|
| 82426 | 7/1941 | New Zealand . | |
| 102355 | 3/1952 | New Zealand . | |
| 106020 | 8/1953 | New Zealand . | |
| 1598986 | 9/1981 | United Kingdom | 227/8 |

*Primary Examiner*—Howard N. Goldberg
*Assistant Examiner*—Taylor J. Ross
*Attorney, Agent, or Firm*—Holman & Stern

[57] ABSTRACT

A box making jig has a rotatable holder which holds side, bottom and end members (usually wooden) in position for stapling together. The holder is held to enable one side to be stapled, the holder is rotated and held to enable the bottom to be stapled, and then the holder is rotated and held again to enable the second side to be stapled to the end members.

2 Claims, 2 Drawing Figures

CONTAINER MAKING DEVICE

This invention relates to container making and has been devised particularly though not solely for making up wooden fruit boxes or trays for various fruits such as apples or kiwi fruit.

It is an object of the present invention to provide a method of and/or apparatus for making containers which will at least provide the public with a useful choice.

Accordingly in one aspect the invention consists in a method of making containers, said method comprising the steps of placing pieces of material preferably wood in the shape of a container having a bottom, two sides and two ends on a pivotal jig, holding the pivotal jig in a first selected position, applying fasteners e.g. staples through fastening devices to fix some of said pieces to others, releasing the holding of the jig, rotating the jig to another position where other pieces can be fastened to form the container and moving the jig to enable fastenings to be made to further pieces to complete the ends, sides and bottom of a container.

In a further aspect the invention consists in apparatus for use in making containers, said apparatus comprising a frame, a pivotal jig mounted on said frame, holding means which in use hold the jig in selected ones of a series of positions, the jigs being adapted to receive pieces of material preferably wooden members to form a container, movable fastening devices, and jig holding means including a releasable latch forming part of latch means, the construction and arrangement being such that on pieces to form the ends, sides and bottom of a container being placed in position on said jig, said fastening devices are movable and operable to fix fasteners to fix some of the members of the container to each other with the jig in one position and on releasing said latch means said jig is pivotal to a further position to enable further pieces to be fixed to each other and then said jig is movable to a still further position to enable further members to be fixed to each other to complete the manufacture of the container.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings in which.

Figure 1:
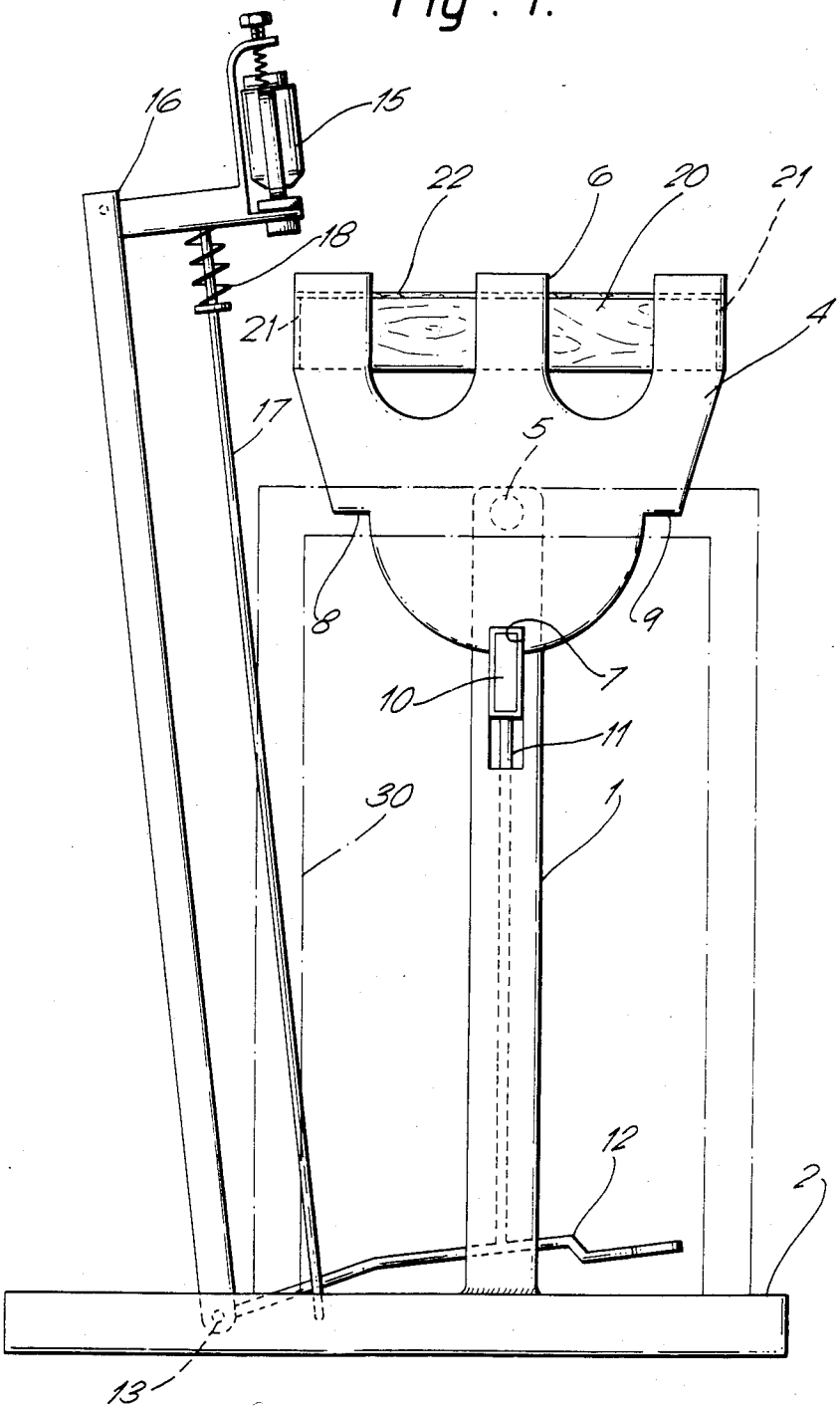
FIG. 1 is a side view of apparatus according to the invention.
Figure 2:
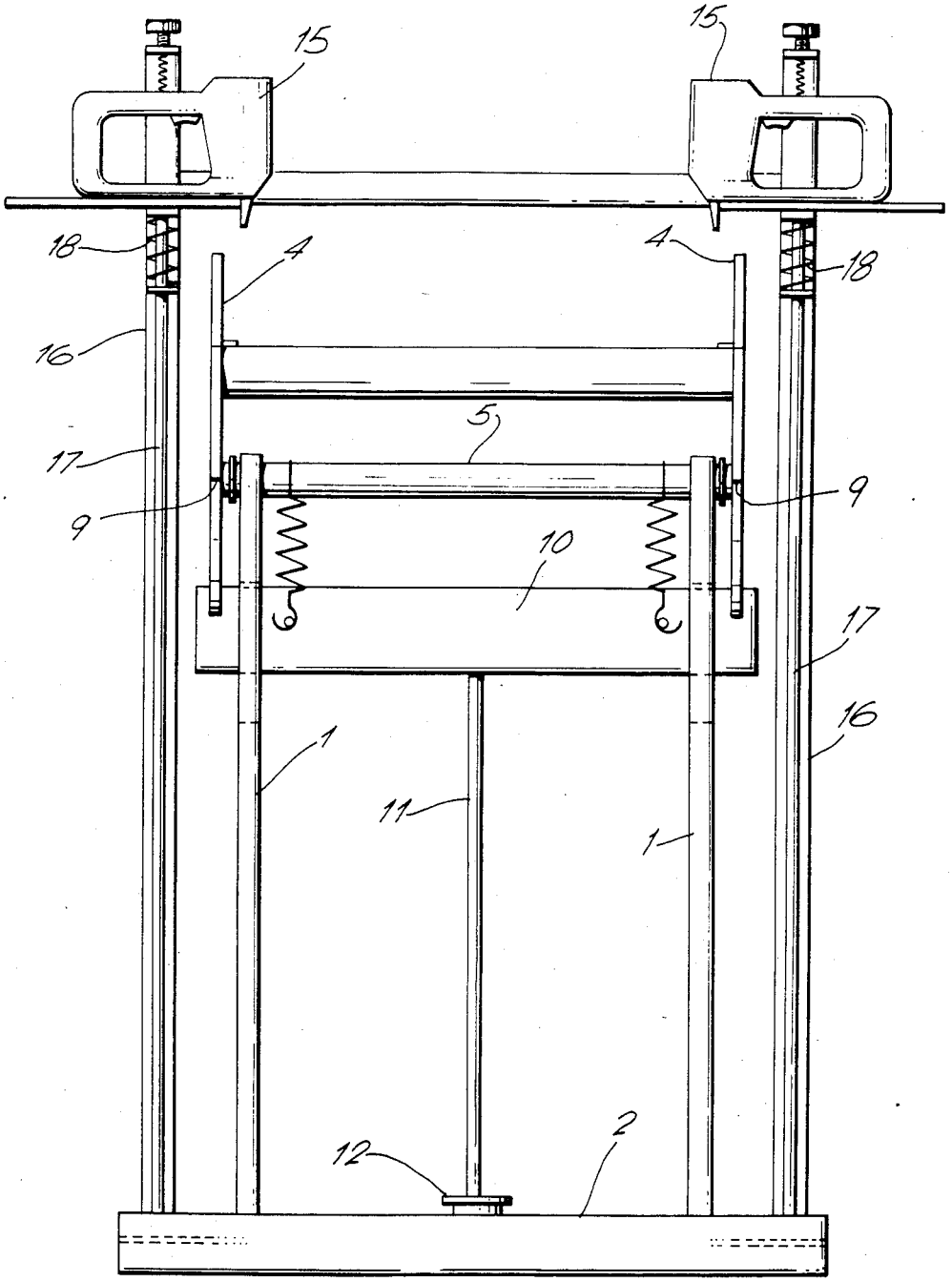
FIG. 2 is a front elevation of the construction shown in FIG. 1.

Referring to the drawings, an apparatus for use in assembling pieces of material e.g. plastics or preferably wooden members to form a container e.g. a fruit box such as an apple box or a kiwi fruit tray is constructed as follows:

A frame is provided comprising uprights 1 and feet 2. Pivotally mounted on the uprights is a jig comprising two side members 4, the side members 4 being spaced apart by a pivotal shaft 5. If desired cut-outs 6 may be provided in the side members. The end plates 4 are pivotal at 5 on the uprights 1 and to control the position of the end members 4 and thus the jig, a notch 7 is provided and further notches 8 and 9, the space between the notch 7 and the shoulders 8 and 9 being formed as an arc of a circle with the centre on the pivot 5. A latch preferably comprising a sliding bolt 10 is provided and a lever operable by a link 11 connect the sliding bolt 10 to a manual or preferably pedal member 12, the member 12 being pivotal at 13 to part of the feet 2. A spring return is provided to keep the sliding bolt 10 in the notch 7 or against the shoulders 8 or 9 unless the pedal 12 is depressed. Of course notches could be provided in place of the shoulders 8 and 9.

Fastening devices preferably staple guns 15 are provided on a swinging frame 16, the swinging frame 16 being maintained in a rearward disposition by a rod 17 and spring 18. The fastening devices may, for example, be any suitable type of automatic fastening machine, for example a Sanko Model L stapling gun.

The use of the apparatus to form a container e.g. a fruit box, is as follows:

The operator places end members 20 of the fruit box against the end members 4, side members 21 of the fruit box across the front and rear of the jig, the side and/or end members being retained in position by one or more suitable spring clips on the jig, and then on top of the ends 20 and side members 21 a bottom member 22 of the fruit box is placed in position, all this occuring when the jig is in the position shown in the drawings. The operator then pulls the frame 16 forward pivoting it on the pivot 13 and operates the staple guns. If desired stops or other locating means can be provided on the jig to position the stapling guns when required. The stapling guns are operated by a manual handle. Thus the operator operates the stapling guns to provide staples to staple the bottom members 22 to the ends 20 of the fruit box and this preferably occurs on both ends simultaneously. The operator then depresses the foot lever 12 and swings the jig so that one of the side members 22 is uppermost e.g. when the shoulder 9 is against the detent 7. The operator again operates the stapling gun to insert staples to staple the sides to the ends of the fruit box, and if necessary to the bottom, although that is not usually necessary, and then the operator swings the jig over until the shoulder 8 engages the detent 10 and repeats the operation. The operator then straightens the jig to the position shown in the figures and removes the completed box and places further wooden members in position ready for a further operation. The foregoing gives the preferred sequence of events which may however be varied if desired.

It will be apparent that some automation can be effected, for example the stapling guns, for example, if pneumatically or electronically actuated may be caused to operate automatically on reaching stop positions provided on the jig by providing jig actuated valves and switches, and the swinging of the frame 16 could also be effected automatically, e.g. by use of pneumatics or electronics. However it is preferred to keep the invention in the simplest form substantially as above described.

If the pivot 5 restricts the depth of the box to be made the upright 1 may be replaced by side frames 30 with . bushed pivots which do not extend to within the side members 4.

In place of the swinging frame 16 a fixed frame may be provided with arms extending over the jig and the stapling guns slidably mounted on such arms particularly where wide containers are to be assembled.

The construction has the major advantage that it is very simple and provides a simple fruit box or packing tray making machine which can be operated by untrained labour and which the machine itself has low capital cost.

What is claimed is:

1. Container assembly apparatus comprising a frame, a container support jig pivotally mounted on the frame, the support jig having holding means for holding side, end and base members of a rectangular box-like container in assembled relation for fastening, fastener means, support means mounting the fastener means on the frame for movement toward and away from the jig and releasable holding means connected between the jig and frame for selectively and releasably holding the jig in any one of three positions separated by 90 degree pivotal increments of the jig for respectively presenting one side member, the base member, and the opposite side member of the container to the fastener means for fastening, wherein the jig is pivotally mounted on frame supports extending vertically from a base member, the holding means comprising a part-circular segment on the jig and a manually operable latch means on the frame for removable engagement in a selected one of three stops formed on the segment plate at 90 degree intervals, and wherein the support means comprises a vertically extending subframe pivotally mounted on the base member adjacent the frame supports, the fastener means carried atop the subframe.

2. The invention of claim 1, including foot pedal means for operating the latch means.

* * * * *